US009242475B2

(12) United States Patent
Otsuka et al.

(10) Patent No.: US 9,242,475 B2
(45) Date of Patent: Jan. 26, 2016

(54) LIQUID EJECTING APPARATUS

(71) Applicant: Seiko Epson Corporation, Tokyo (JP)

(72) Inventors: Nobutoshi Otsuka, Azumino (JP); Jun Shimazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/606,496

(22) Filed: Jan. 27, 2015

(65) Prior Publication Data

US 2015/0224786 A1 Aug. 13, 2015

(30) Foreign Application Priority Data

Feb. 7, 2014 (JP) ..... 2014-022005

(51) Int. Cl.

| | |
|---|---|
| ***B41J 2/17*** | (2006.01) |
| ***B41J 2/18*** | (2006.01) |
| ***B41J 2/19*** | (2006.01) |
| ***B41J 2/175*** | (2006.01) |

(52) U.S. Cl.

CPC .. *B41J 2/19* (2013.01); *B41J 2/175* (2013.01); *B41J 2/17596* (2013.01); *B41J 2/18* (2013.01)

(58) Field of Classification Search

CPC .... B41J 2/17563; B41J 2/17596; B41J 2/185; B41J 2/19

See application file for complete search history.

(56) References Cited

U.S. PATENT DOCUMENTS

| | | | | |
|---|---|---|---|---|
| 2009/0167829 | A1* | 7/2009 | Iijima | 347/92 |
| 2009/0295881 | A1 | 12/2009 | Tasaka et al. | |
| 2010/0085396 | A1 | 4/2010 | Yokota et al. | |
| 2011/0199424 | A1 | 8/2011 | Yokouchi et al. | |
| 2011/0211029 | A1 | 9/2011 | Enomoto et al. | |
| 2013/0002772 | A1* | 1/2013 | Hiratsuka et al. | 347/85 |
| 2013/0293643 | A1* | 11/2013 | Shinoda et al. | 347/100 |

FOREIGN PATENT DOCUMENTS

| | | | |
|---|---|---|---|
| EP | 1886815 | A1 | 2/2008 |
| EP | 2050572 | A2 | 4/2009 |
| EP | 2127883 | A1 | 12/2009 |
| JP | 2009-285837 | A | 12/2009 |
| JP | 2011-178013 | A | 9/2011 |
| JP | 2011-178014 | A | 9/2011 |
| JP | 2011-183795 | A | 9/2011 |
| JP | 2011-201231 | A | 10/2011 |
| JP | 2012-171191 | A | 9/2012 |
| JP | 2013-075371 | A | 4/2013 |

* cited by examiner

*Primary Examiner* — Kristal Feggins
*Assistant Examiner* — Kendrick Liu

(57) ABSTRACT

A liquid ejecting apparatus includes a plurality of nozzles which eject liquid; a common liquid chamber which supplies liquid to the plurality of nozzles; a liquid flow path for supplying liquid which is accommodated in a liquid accommodation unit to the common liquid chamber; a deaeration unit which deaerates liquid in the liquid flow path; a liquid flow unit which causes liquid in the liquid flow path to flow; a return flow path which connects the common liquid chamber and the liquid accommodation unit; and an on-off valve which closes the return flow path by being in a closed state.

8 Claims, 4 Drawing Sheets

LIQUID EJECTING APPARATUS

CROSS REFERENCE TO RELATED APPLICATION(S)

This application claims priority under 35 U.S.C. §119 to Japanese Application No. 2014-022005, filed Feb. 7, 2014, the content of which is hereby incorporated by reference in its entirety.

BACKGROUND

1. Technical Field

The present invention relates to a liquid ejecting apparatus such as a printer.

2. Related Art

As an example of a liquid ejecting apparatus, there is an ink jet printer which performs printing by ejecting ink from nozzles which are provided in a recording head. Among such printers, there is a printer which suppresses dot omission which occurs when air bubbles are mixed in nozzles by performing deaeration of ink in a liquid storage chamber which stores ink which will be supplied to a recording head (for example, JP-A-2013-75371).

Meanwhile, in the above described printer, sedimentation of a pigment component which is included in ink is suppressed by circulating ink between a liquid storage chamber and a recording head when printing is not performed. When ink is circulated in this manner, it is also possible to expect an effect that air bubbles which are mixed into a flow path is collected in the liquid storage chamber. However, since a degree of deaeration of ink in the liquid storage chamber is decreased when ink containing air bubbles is collected, there is a problem in that deaeration of ink should be performed every time circulation is performed, and efficiency of deaeration deteriorates.

In addition, such a problem is not limited to a printer which performs printing by ejecting pigment ink, and is generally common to liquid ejecting apparatuses in which there is a concern that air bubbles which grow in liquid or air bubbles which are mixed into liquid may cause an ejection failure of liquid.

SUMMARY

An advantage of some aspects of the invention is to provide a liquid ejecting apparatus in which mixing of air bubbles into liquid or a growth of air bubbles in liquid which is accompanied with ejection is reduced.

Hereinafter, units for solving the above described problem and operation effects thereof will be described.

A liquid ejecting apparatus includes a plurality of nozzles which eject liquid; a common liquid chamber which supplies liquid to the plurality of nozzles; a liquid flow path for supplying liquid which is accommodated in a liquid accommodation unit to the common liquid chamber; a deaeration unit which deaerates liquid in the liquid flow path; a liquid flow unit which causes liquid in the liquid flow path to flow; a pressure adjusting unit which is provided between the deaeration unit and the common liquid chamber in the liquid flow path, and adjusts a pressure of liquid which is supplied to the common liquid chamber; a return flow path which connects the common liquid chamber and the liquid accommodation unit; and an on-off valve which closes the return flow path by being in a closed state.

According to the configuration, it is possible to collect air bubbles which are mixed in the common liquid chamber or a liquid flow path in the liquid accommodation unit by causing liquid in the common liquid chamber to flow to the liquid accommodation unit through the return flow path. In addition, it is possible to eject deaerated liquid from nozzles, since deaeration of liquid is performed using a deaeration unit in the liquid flow path through which liquid is supplied to the common liquid chamber. That is, by performing deaeration in the liquid flow path, it is possible to reduce mixing of air bubbles into liquid which is accompanied with ejection, or a growth of air bubbles in liquid compared to a case in which deaeration of liquid is performed in the liquid accommodation unit.

In the liquid ejecting apparatus, liquid in the common liquid chamber may be collected in the liquid accommodation unit when liquid in the return flow path is caused to flow toward the liquid accommodation unit by opening the on-off valve.

According to the configuration, it is possible to collect liquid in the common liquid chamber into the liquid accommodation unit without passing through the deaeration unit by causing liquid on the return flow path to flow toward the liquid accommodation unit by opening the on-off valve. In this manner, it is possible to efficiently perform deaeration of liquid which is accompanied with ejection by suppressing intermixing of liquid which is subjected to deaeration and liquid including air bubbles.

The liquid ejecting apparatus may further include a bypass flow path of which an upstream end is connected between the deaeration unit and the pressure adjusting unit in the liquid flow path, and of which a downstream end is connected between the on-off valve and the common liquid chamber on the return flow path; and a switching valve which is provided at a connection portion between the bypass flow path and the liquid flow path, and switches a flow path of liquid which flows toward the common liquid chamber from the deaeration unit between the liquid flow path and the bypass flow path, in which liquid may be supplied to the pressure adjusting unit through the liquid flow path in a state in which the on-off valve is closed, and the switching valve may switch the flow path of liquid to the liquid flow path, when liquid is ejected from the nozzle, and in which liquid may be supplied to the common liquid chamber through the bypass flow path in a state in which the on-off valve is closed, and the switching valve may switch the flow path of the liquid to the bypass flow path, when maintenance of causing liquid to flow out from the nozzle is performed.

According to the configuration, it is possible to supply liquid of which a pressure is appropriately adjusted in the pressure adjusting unit to the nozzle by supplying the liquid to the pressure adjusting unit through the liquid flow path, when the liquid is ejected from the nozzle. Meanwhile, when maintenance is performed, it is possible to cause liquid of which the pressure is not adjusted to flow out from the nozzle powerfully, by supplying the liquid to the common liquid chamber through the bypass flow path without passing through the pressure adjusting unit.

In the liquid ejecting apparatus, the pressure adjusting unit may include a pressure chamber of which a volume is changed when a flexible unit which configures a wall portion performs deflection displacement; a supply chamber which communicates with the pressure chamber through a communication flow path; an urging member which urges the flexible unit in a direction in which the volume of the pressure chamber increases; and a valve which is displaced in a direction which causes communication between the pressure chamber and the supply chamber according to a displacement of the flexible unit, when a pressure in the pressure chamber is lower than a pressure on an outer side of the flexible unit, in which the supply chamber may communicate with the deaeration unit through the liquid flow path, and the pressure chamber may communicate with the common liquid chamber through the liquid flow path, and in which a pressure in the pressure chamber decreases due to supplying of liquid in the pressurizing chamber to the common liquid chamber when the liquid flow unit supplies liquid which is in a pressurized state from the deaeration unit to the supply chamber, and liquid flows out from the nozzle.

According to the configuration, when liquid is flown out from the nozzle, the flexible unit performs deflection displacement in a direction in which a volume of the pressure chamber decreases due to a decrease in pressure of the pressure chamber when liquid in the pressure chamber is supplied to the common liquid chamber. In addition, the valve causes the pressure chamber and the supply chamber to communicate with each other according to a displacement of the flexible unit. In addition, since deaerated liquid is supplied to the supply chamber in a state of being pressurized using the liquid flow unit, when the pressure chamber and the supply chamber communicate with each other, liquid rapidly flows into the pressure chamber from the supply chamber. In addition, when a pressure of the pressure chamber returns to the original state due to flowing in of liquid, flowing in of liquid to the pressure chamber from the supply chamber is stopped due to an urging force of the urging member. On the other hand, when liquid is not flown out from the nozzle, since the pressure in the pressure chamber does not decrease, and pressurized liquid does not flow into the common liquid chamber through the pressure chamber, a meniscus in liquid which is formed in the nozzle is not destroyed due to the pressure. That is, it is possible to appropriately adjust a pressure in the common liquid chamber according to flowing out of liquid from the nozzle using the pressure adjusting unit.

In the liquid ejecting apparatus, a foreign substance capturing unit may be further included between the liquid accommodation unit and the deaeration unit in the liquid flow path.

According to the configuration, it is possible to suppress mixing in of foreign substances in the deaeration unit by capturing foreign substances which are mixed into liquid using the foreign substance capturing unit in the middle of the liquid flow path which goes toward the deaeration unit from the liquid accommodation unit.

In the liquid ejecting apparatus, the deaeration unit may include a depressurizing mechanism which depressurized liquid in the liquid flow path for deaeration, and the liquid flow unit may supply liquid which is in a pressurized state from the deaeration unit to the common liquid chamber.

According to the configuration, it is possible to perform deaeration by eliminating a gas in liquid when the depressurizing mechanism performs depressurizing of liquid. In addition, it is possible to cause liquid to flow from the deaeration unit to the common liquid chamber by pressurizing liquid which is depressurized using the liquid flow unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus will be described with reference to drawings. The liquid ejecting apparatus is, for example, an ink jet printer which performs recording (printing) by ejecting pigment ink which is an example of liquid on a medium such as a sheet.

Figure 1:
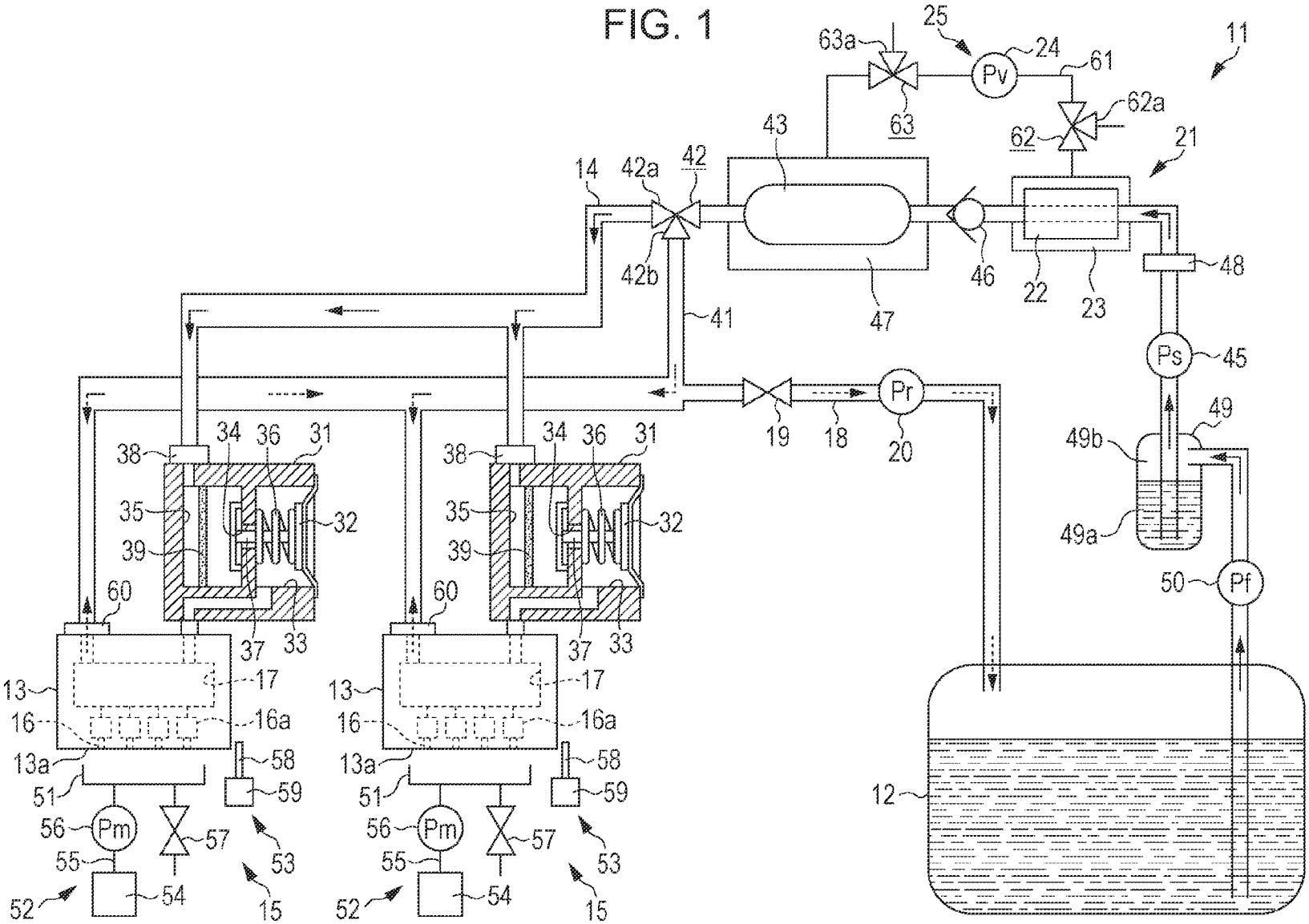
FIG. 1 is a schematic view which illustrates a configuration of a liquid ejecting apparatus according to one embodiment.

As illustrated in FIG. 1, a liquid ejecting apparatus 11 includes a liquid accommodation unit 12 which accommodates liquid, a plurality of liquid ejecting units 13 which eject liquid, a liquid flow path 14 for supplying liquid which is accommodated in the liquid accommodation unit 12 to the liquid ejecting unit 13, and a maintenance unit 15 which performs maintenance of the liquid ejecting unit 13. The liquid accommodation unit 12 is also be configured so as to pour liquid through a pouring hole (not illustrated) in a state of being mounted on the liquid ejecting apparatus 11, and it is also possible to adopt a configuration in which a carriage-shaped liquid accommodation unit 12 is detachably mounted on the liquid ejecting apparatus 11.

The liquid ejecting unit 13 includes a plurality of nozzles 16 which ejects liquid, and a common liquid chamber 17 for supplying liquid which is supplied from the liquid accommodation unit 12 to the plurality of nozzles 16 through a liquid flow path 14. The number of liquid ejecting units 13 and nozzles 16 is arbitrarily changed. As a mechanism for ejecting liquid from the nozzle 16, it is possible to adopt an actuator which includes a piezoelectric element which contracts when being electrically connected, for example. In this case, liquid is ejected (discharged) as liquid droplets from the nozzle 16 when a volume of a liquid chamber 16*a* which is provided between the common liquid chamber 17 and the nozzle 16 is changed due to contraction of the piezoelectric element.

The liquid ejecting apparatus 11 includes a return flow path 18 which connects the common liquid chamber 17 and the liquid accommodation unit 12, an on-off valve 19 which closes the return flow path 18 by being in a closed state, and a circulation pump 20 for causing liquid to flow from the common liquid chamber 17 to the liquid accommodation unit 12. When a plurality of the liquid ejecting units 13 are provided, a downstream side of the liquid flow path 14 and an upstream side of the return flow path 18 which are connected to the common liquid chamber 17 branch into a plurality of paths according to the number of common liquid chambers 17.

A deaeration unit 21 which deaerates liquid in the liquid flow path 14 is provided in the liquid flow path 14. The deaeration unit 21 includes a cylindrical hollow fiber membrane 22 which forms a part of the liquid flow path 14, and a depressurizing mechanism 25 which depressurizes liquid in the liquid flow path 14 for deaeration, for example. In this case, the depressurizing mechanism 25 includes a depressurizing chamber 23 which accommodates the hollow fiber membrane 22, and a vacuum pump 24 which depressurizes the depressurizing chamber 23. In addition, liquid on the inside of the hollow fiber membrane 22 is deaerated when the vacuum pump 24 depressurizes the depressurizing chamber 23, a space on the outer side of the hollow fiber membrane 22 is depressurized, and a gas dissolved in liquid on the inside of the hollow fiber membrane 22 is suctioned outward from the hollow fiber membrane 22.

A pressure adjusting unit 31 which adjusts a pressure of liquid which is supplied to the liquid ejecting unit 13 is provided between the deaeration unit 21 and the liquid ejecting unit 13 in the liquid flow path 14. The pressure adjusting unit 31 includes, for example, a pressure chamber 33 of which a volume is changed when a flexible unit 32 which configures a wall portion performs deflection displacement, a supply chamber 35 which communicates with the pressure chamber through a communication flow path 34, an urging member 36 which urges the flexible unit in a direction in which the volume of the pressure chamber 33 increases, and a valve 37 which closes the communication flow path 34. The supply chamber 35 communicates with the deaeration unit 21 through the liquid flow path 14, and the pressure chamber 33 communicates with the common liquid chamber 17 through the liquid flow path 14.

In addition, foreign substances such as air bubbles are easily accumulated at a portion in which a cross-sectional area of flow path increases such as the supply chamber 35 or the pressure chamber 33, a portion in a complicated shape such as the urging member 36, or the like. For this reason, according to the embodiment, in order to capture the foreign substances such as air bubbles, filters 38 and 39 are provided at an entrance of the pressure adjusting unit 31 and in the pressure adjusting unit 31, respectively. It is possible to arbitrarily change the number and arrangements of filters 38 and 39, and it is also possible to omit the filters 38 and 39.

It is preferable for the liquid ejecting apparatus 11 to be provided with a bypass flow path 41 of which an upstream end is connected between the deaeration unit 21 and the pressure adjusting unit 31 in the liquid flow path 14, and of which a downstream end is connected between the on-off valve 19 and the common liquid chamber 17 on the return flow path 18. In addition, it is preferable to include a switching valve 42 which switches a flow path of liquid which flows from the deaeration unit 21 to the common liquid chamber 17 between the liquid flow path 14 and the bypass flow path 41 at a connection portion of the bypass flow path 41 and the liquid flow path 14.

The switching valve 42 is set to a three-way valve which includes three valves which individually closes three flow paths of the bypass flow path 41, an upstream side of a connection portion with the bypass flow path 41 in the liquid flow path 14, and a downstream side of the connection portion with the bypass flow path 41 in the liquid flow path 14.

It is preferable to provide a storage unit 43 which temporarily stores liquid which is deaerated using the deaeration unit 21 between the deaeration unit 21 and the switching valve 42 in the liquid flow path 14. In addition, it is preferable to provide a pressurizing pump 45 which supplies liquid in a pressurized state from the deaeration unit 21 to the liquid ejecting unit 13 between the deaeration unit 21 and the liquid accommodation unit 12 in the liquid flow path 14.

The pressurizing pump 45 functions as a liquid flow unit which causes liquid in the liquid flow path 14 to flow. That is, since liquid in the liquid flow path 14 is depressurized in the deaeration unit 21, it is possible to efficiently supply liquid toward the liquid ejecting unit 13 by storing the deaerated liquid in the storage unit 43 in a state of being pressurized using the pressurizing pump 45.

In addition, it is preferable to provide a one-way valve 46 which allows flowing of liquid from the deaeration unit 21 to the storage unit 43, and regulates flowing of liquid from the storage unit 43 to the deaeration unit 21, on the other hand, between the deaeration unit 21 and the storage unit 43 in the liquid flow path 14. The reason for this is that it is possible to suppress a backflow of liquid from the storage unit 43 which is in a positive pressure state due to pressurizing to the deaeration unit 21 which is in a negative pressure state due to depressurizing, in this manner.

In addition, a configuration may be adopted in which an accommodation bag which is flexible is adopted as the storage unit 43, the storage unit 43 which is formed of such an accommodation bag is accommodated in the pressurizing chamber 47, and a gas which is suctioned in order to perform depressurizing using the vacuum pump 24 is introduced to the pressurizing chamber 47 through a gas flow path 61. In this case, it is possible to pressurize liquid in the pressurizing chamber through the accommodation bag by introducing a gas to the pressurizing chamber 47 by driving the vacuum pump 24.

In addition, when adopting such a configuration, if three-way valves 62 and 63 are respectively arranged on the upstream side and the downstream side of the vacuum pump 24 on the gas flow path 61, it is possible to arbitrarily set a timing for depressurizing the depressurizing chamber 23, and a timing for pressurizing the pressurizing chamber 47.

That is, when depressurizing of the depressurizing chamber 23 and pressurizing of the pressurizing chamber 47 are performed at the same time, a gas in the depressurizing chamber 23 may be introduced to the pressurizing chamber 47 by driving the vacuum pump 24 by closing valves 62*a* and 63*a* which communicate with the outside of the three-way valves 62 and 63. In addition, when the depressurizing of the depressurizing chamber 23 is independently performed, the gas which is suctioned from the depressurizing chamber 23 may be discharged to the outside by driving the vacuum pump 24 by closing the valve 62*a* and opening the valve 63*a*. In addition, when pressurizing of the pressurizing chamber 47 is independently performed, a gas on the outside may be taken into the gas flow path 61, and may be introduced to the pressurizing chamber 47 by driving the vacuum pump 24 by opening the valve 62*a* and closing the valve 63*a*.

It is preferable to provide a foreign substance capturing unit which captures foreign substances such as air bubbles or dust which are mixed into liquid, solidified substance from solute components which are dissolved in liquid, or the like, between the deaeration unit 21 and the liquid accommodation unit 12 in the liquid flow path 14. The foreign substance capturing unit may be a filter 48 for filtering liquid, an air trap 49 for capturing air bubbles which are mixed into liquid, or a filter and an air trap may be used in combination according to there being a high probability of foreign substances being mixed in.

In addition, when the air trap 49 separates a gas from liquid by including a liquid storage unit 49*a* and a gas storage unit 49*b* which communicate with each other, it is preferable to include a discharging pump 50 which causes liquid to flow from the liquid accommodation unit 12 to the liquid storage unit 49*a*.

The maintenance unit 15 includes a cap 51 which forms a closed space to which the nozzle 16 which is provided in the liquid ejecting unit 13 is open, a suction mechanism 52, and a wiper unit 53. The suction mechanism 52 includes a waste liquid tank 54, a discharge flow path 55 which connects the waste liquid tank 54 and the cap 51, and a depressurizing pump 56 which is arranged at a position in the middle of the discharge flow path 55. In addition, an atmosphere opening valve 57 for opening a closed space to atmosphere is provided in the cap 51.

The cap 51 performs capping in which a closed space is formed by covering a region including an opening face 13*a*, by being in contact with the opening face 13*a* to which the nozzle 16 is open in the liquid ejecting unit 13, for example. In addition, the capping is performed by causing the liquid ejecting unit 13 to move in a direction which is close to the cap 51, or by causing the cap 51 to move in a direction which is close to the liquid ejecting unit 13. In addition, at the time of capping, a target with which the cap 51 comes into contact is not limited to the opening face 13*a*, and for example, it is also possible to form a closed space to which the nozzle 16 opens by covering the region including the opening face 13*a*, by causing the cap 51 to come into contact with a side face portion of the liquid ejecting unit 13, a holding member which holds the liquid ejecting unit 13, or the like, for example.

In addition, when the depressurizing pump 56 is driven in a state in which capping is performed, suction cleaning in which the closed space is in a negative pressure state, and liquid is suctioned and discharged from the common liquid chamber 17, or the like, through the nozzle 16 is executed.

That is, when the depressurizing pump 56 is driven, and the closed space is in the negative pressure state, the inside of the pressure chamber 33 is depressurized, when liquid is discharged from the nozzle 16, and the liquid in the pressure chamber 33 flows into the common liquid chamber 17. As a result, the flexible unit 32 which configures a wall portion of the pressure chamber 33 performs deflection displacement in a direction in which the volume of the pressure chamber 33 is decreased. In addition, the valve 37 is displaced in a direction in which the pressure chamber 33 and the supply chamber 35 communicate with each other (left direction in FIG. 1) according to the displacement of the flexible unit 32.

When there is a state in which the pressure chamber 33 and the supply chamber 35 communicate with each other (state of pressure adjusting unit 31 on right side in FIG. 1) due to the displacement of the valve 37, liquid flows into the pressure chamber 33 from the supply chamber 35 in the pressurized state. Thereafter, since liquid does not flow out from the nozzle 16 when driving of the depressurizing pump 56 is stopped, the flexible unit 32 is displaced in a direction in which the volume of the pressure chamber 33 increases, and the valve 37 closes the communication flow path 34 by returning to the original position along with an increase in pressure in the pressure chamber 33. In this manner, in the pressure adjusting unit 31, liquid is supplied to the common liquid chamber 17 through the liquid flow path 14 while suction is performed on the nozzle 16 side.

When capping is released after the execution of such suction cleaning, it is preferable to separate the cap 51 from the liquid ejecting unit 13 after opening the closed space to the atmosphere, by causing the atmosphere opening valve 57 to be in an open state.

The wiper unit 53 includes a wiper 58 which wipes the opening face 13*a*, and a moving body 59 which moves by holding the wiper 58. In addition, a wiping operation in which the opening face 13*a* is wiped using the wiper 58 is executed when the moving body 59 moves along the opening face 13*a* in a state in which a tip end of the wiper 58 comes into contact with the opening face 13*a*. In addition, the wiping is also performed when the liquid ejecting unit 13 moves in a state of being in contact with the wiper 58.

In addition to this, as maintenance of the liquid ejecting unit 13, a flushing operation in which liquid in the nozzle 16 is discharged by ejecting liquid from the liquid ejecting unit 13 to the cap 51 is executed. The flushing is performed in order to prevent or resolve clogging of the nozzle 16 between printing operations, or is performed so as to adjust the meniscus of liquid which is formed in the nozzle 16, after the wiping, or the like, for example.

Figure 2:
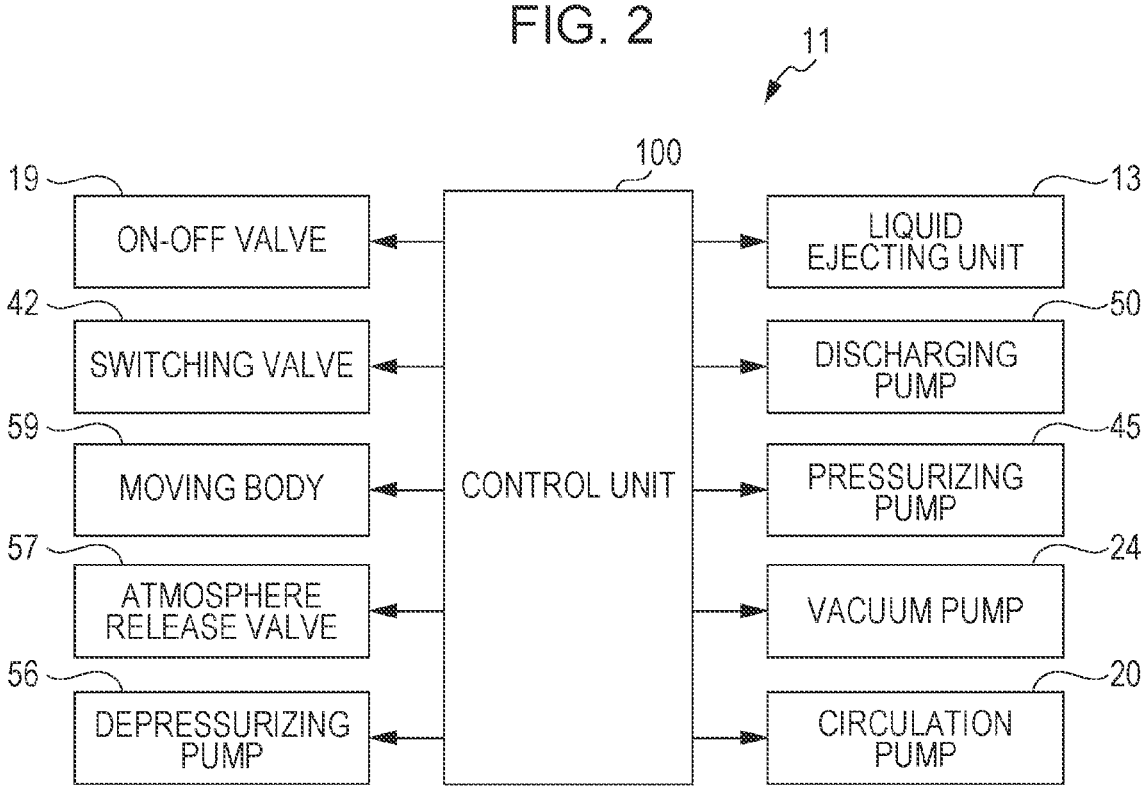
FIG. 2 is a block diagram which illustrates an electric configuration of the liquid ejecting apparatus according to the embodiment.

In addition, as illustrated in FIG. 2, a control unit 100 which performs control of constituent elements which configure the liquid ejecting apparatus 11 such as the liquid ejecting unit 13, the discharging pump 50, the pressurizing pump 45, the vacuum pump 24, a circulation pump 20, the on-off valve 19, the switching valve 42, the moving body 59, the atmosphere opening valve 57, the depressurizing pump 56, and the like, is provided. As the control unit 100, a plurality of control units which individually control the constituent elements is provided, and it is also possible to provide a control unit which performs an overall control of the plurality of constituent elements.

In the liquid ejecting apparatus 11, a state in which the on-off valve 19 and the atmosphere opening valve 57 are closed, and a flow path of liquid is switched to the liquid flow path 14 using the switching valve 42 due to a control of the control unit 100 is set to a normal state. In addition, in the normal state, drying of the nozzle 16 is suppressed when the control unit 100 performs capping of the liquid ejecting unit 13 using the cap 51.

When the liquid ejecting apparatus 11 is started up, driving of the discharging pump 50 and the pressurizing pump 45 is controlled by the control unit 100 so that the inside of the storage unit 43 is maintained so as to have a predetermined positive pressure (pressurized state). In this manner, in the normal state, the storage unit 43, the supply chamber 35, and the liquid flow path 14 between the storage unit 43 and the supply chamber 35 are maintained in a predetermined pressurized state. In addition, the control unit 100 performs depressurizing of the depressurizing chamber 23 by controlling the vacuum pump 24 and the three-way valves 62 and 63 according to driving of the pressurizing pump 45, and sends deaerated liquid to the storage unit 43.

In addition, even when liquid in the supply chamber 35 is in a pressurized state, the liquid does not flow from the supply chamber 35 to the pressure chamber 33 while a state in which the valve 37 closes the communication flow path 34 (state of pressure adjusting unit 31 on left side in FIG. 1) using an urging force of the urging member 36 is maintained in the pressure adjusting unit 31.

Subsequently, operations of the liquid ejecting apparatus 11, and various processes which are executed by the control unit 100 will be described.

First, a first pouring process which is executed in order to pour liquid in the liquid flow path 14 into the common liquid chamber 17, and a second pouring process which is executed in order to pour liquid in the common liquid chamber 17 into the nozzle 16, subsequently to the first pouring process which are performed when starting use of the liquid ejecting apparatus 11, or the like, will be described. In addition, the first pouring process and the second pouring process are started in the above described normal state. In the normal state, the atmosphere opening valve 57 of the cap 51 is in a closed state.

Figure 3:
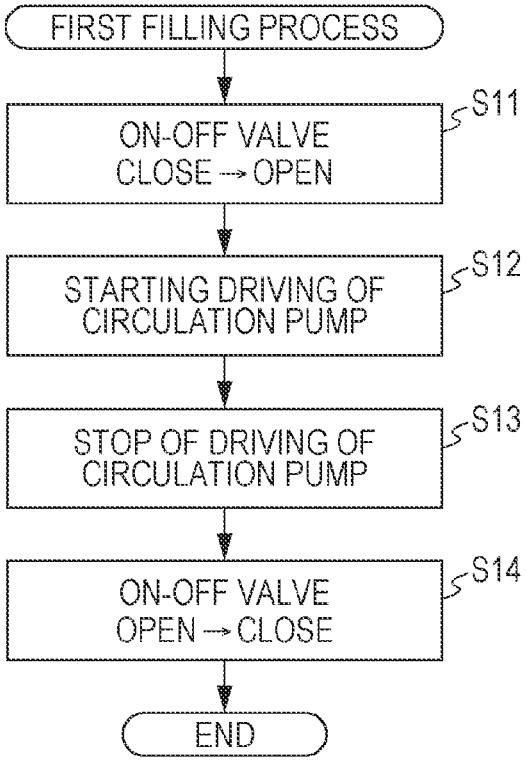
FIG. 3 is a flowchart which illustrates execution order of a first pouring process.

The first pouring process is performed when the control unit 100 executes the process which is illustrated in FIG. 3.

As illustrated in FIG. 3, as step S11, the control unit 100 changes the on-off valve 19 from a closed state which is the normal sate to an open state.

Subsequently, in step S12, the control unit 100 starts driving of the circulation pump 20. Then, liquid in the common liquid chamber 17 flows to the liquid accommodation unit 12 through the return flow path 18, and as a result, liquid in the pressure chamber 33 is supplied to the common liquid chamber 17, and the inside of the pressure chamber 33 is depressurized. Then, the flexible unit 32 which configures the wall portion of the pressure chamber 33 performs deflection displacement in a direction in which the volume of the pressure chamber 33 is decreased. In addition, the valve 37 is displaced in a direction (left direction in FIG. 1) in which the pressure chamber 33 and the supply chamber 35 communicate with each other according to the displacement of the flexible unit 32.

When the pressure chamber 33 and the supply chamber 35 are in a communicating state (state of pressure adjusting unit 31 on right side in FIG. 1) due to the displacement of the valve 37, liquid flows into the pressure chamber 33 from the supply chamber 35 in the pressurized state. In addition, liquid flows in order of the pressure chamber 33, the common liquid chamber 17, and the return flow path 18 along with driving of the circulation pump 20. At this time, in the supply chamber 35, liquid is supplied from the storage unit 43 in a pressurized state through the liquid flow path 14, and liquid in the storage unit 43 is replenished from the liquid accommodation unit 12 due to driving of the pressurizing pump 45 and the discharging pump 50 as denoted by the solid line arrow in FIG. 1.

Subsequently, as step S13, the control unit 100 stops driving of the circulation pump 20. Then, since liquid does not flow out from the common liquid chamber 17 to the return flow path 18, the flexible unit 32 is displaced in a direction in which the volume of the pressure chamber 33 increases along with an increase in pressure of the pressure chamber 33, and the valve 37 closes the communication flow path 34 by returning to the original position.

In addition, as step S14, when the control unit 100 puts the on-off valve 19 back to the normal state which is the closed state from the open state, the first pouring process is finished. In this manner, pouring of liquid with respect to the common liquid chamber 17 is completed.

In addition, when the filters 38 and 39 are provided in the liquid flow path 14, or the like, since a pressure loss on the flow path increases, it is difficult to cause liquid to flow to the pressure chamber 33 even when the liquid is supplied by being pressurized. For this reason, a configuration may be adopted in which the switching valve 42 is set to a three-way valve which includes the valve 42*a* which is arranged in the liquid flow path 14 on the downstream side of the connection portion with the bypass flow path 41, and the valve 42*b* which is arranged on the bypass flow path 41, the valve 42*a* is open for a fixed time between step S12 and step S13, and then the valve 42*a* is opened. By doing so, it is possible to efficiently perform pouring of liquid by causing liquid pressurized in a region which is in a negative pressure state along with opening of the valve 42*a* to flow at once, since the negative pressure in the pressure chamber 33 influences the valve 42*a* while the valve 42*a* is open.

Subsequently, the second pouring process will be described with reference to FIG. 4.

The second pouring process is executed as a preparation operation in which liquid is poured up to the common liquid chamber 17 using the first pouring process, and then the liquid in the common liquid chamber 17 is set to a state in which printing is performed by being poured into the nozzle 16.

Figure 4:
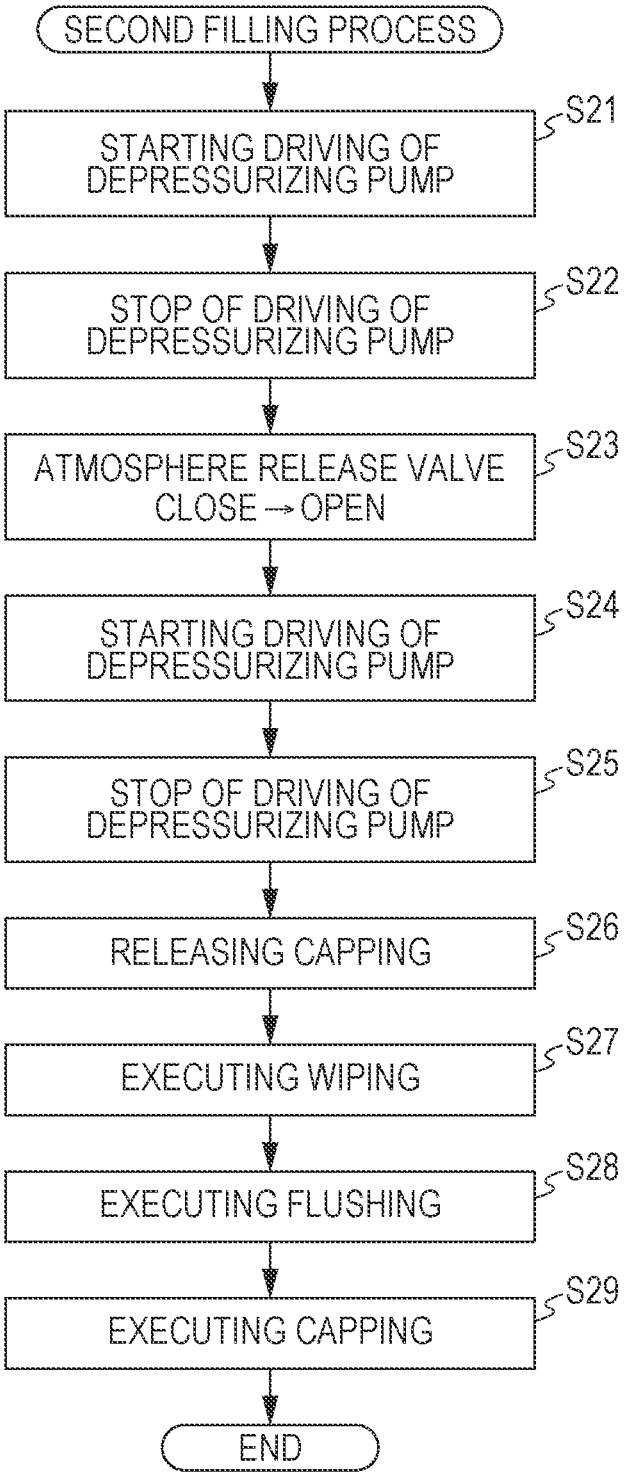
FIG. 4 is a flowchart which illustrates execution order of a second pouring process.

As illustrated in FIG. 4, as step S21, the control unit 100 causes driving of the depressurizing pump 56 to be started. Then, the closed space which is formed using capping is depressurized, liquid is suctioned through the nozzle 16, and is flown out into the cap 51.

Subsequently, as step S22, the control unit 100 stops driving of the depressurizing pump 56.

In addition, as step S23, the control unit 100 changes the atmosphere opening valve 57 from a closed state to an open state. In this manner, the closed space is open to atmosphere, and flowing out of liquid from the nozzle 16 is stopped. At this time, liquid is poured into the nozzle 16.

Subsequently, as step S24, the control unit 100 causes the driving of the depressurizing pump 56 to be restarted. In this manner, the liquid accumulated in the cap 51 is discharged to the waste liquid tank 54 through the discharge flow path 55. When discharging of the liquid in the cap 51 is completed, as step S25, the control unit 100 stops driving of the depressurizing pump 56.

Subsequently, as step S26, the control unit 100 releases capping. In addition, it is also possible to perform releasing of capping in step S26 between steps S23 and S24. In this case, discharging of liquid which is accumulated in the cap 51 is performed in a state in which capping is released.

In addition, as step S27, the control unit 100 executes wiping by moving the moving body 59. In this manner, liquid droplets, and the like, which are discharged from the nozzle 16 due to suction, and are attached to the opening face 13*a* are eliminated.

In addition, the second pouring process is finished when the control unit 100 fixes a meniscus of the nozzle 16 by executing flushing as step S28, and the control unit 100 executes capping as step S29. In addition, when printing is started immediately after the execution of the second pouring process, or the like, the capping in step S29 may not be performed.

In this manner, when liquid is poured up to the nozzle 16 by performing the first and second pouring processes, the liquid ejecting apparatus 11 enters a state in which printing is executed. In addition, a series of operations which is executed in the second pouring process is the same as the operation in suction cleaning which is a maintenance operation in which foreign substances such as air bubbles are discharged through the nozzle 16.

However, in the suction cleaning, a driving time of the depressurizing pump 56 is set so that liquid of an amount which is necessary for discharging of foreign substances is discharged from the nozzle 16; however, in contrast to this, in the second pouring process, liquid of an amount which is necessary for pouring in the nozzle 16 may flow. For this reason, normally the driving time of the depressurizing pump 56 in the second pouring process is shorter than a time for suction cleaning.

In addition, when the liquid ejecting apparatus 11 performs printing, the control unit 100 releases capping, and ejects liquid to a medium from the liquid ejecting unit 13.

In addition, when liquid flows out from the nozzle 16 along with ejection of liquid, and liquid in the common liquid chamber 17 decreases, a pressure in the pressure chamber 33 decreases due to flowing in of liquid in the common liquid chamber 17 from the pressure chamber 33. That is, a pressure in the pressure chamber 33 decreases due to supplying of liquid in the pressure chamber 33 to the common liquid chamber 17 when liquid flows out from the nozzle 16. Then, the flexible unit 32 performs deflection displacement in a direction in which the volume of the pressure chamber 33 is decreased. In addition, when the pressure in the pressure chamber 33 becomes lower than a pressure on the outer side of the flexible unit 32, the valve 37 is displaced in a direction in which the pressure chamber 33 and the supply chamber 35 communicate with each other according to the displacement of the flexible unit 32.

When the pressure chamber 33 and the supply chamber 35 are in a communicating state due to the displacement of the valve 37, liquid flows in from the supply chamber 35 which is in the pressurized state to the pressure chamber 33. At this time, as denoted by the solid line arrow in FIG. 1, the pressurizing pump 45 supplies liquid in a pressurized state from the deaeration unit 21 to the supply chamber 35 of the pressure adjusting unit 31, and the discharging pump 50 supplies liquid from the liquid accommodation unit 12 to the liquid storage unit 49*a*.

In addition, when the flexible unit 32 is displaced in a direction in which the volume of the pressure chamber 33 increases along with flowing in of liquid, the valve 37 returns to the original position, and closes the communication flow path 34. In this manner, liquid is rapidly supplied from the supply chamber 35 in a pressurized state when liquid in the pressure chamber 33 is consumed, and meanwhile, when liquid is not consumed, the valve 37 closes the communication flow path 34, and an increase in pressure of the liquid from the pressure chamber 33 to the nozzle 16 is suppressed.

In addition, when pressurizing and depressurizing of liquid is repeated in the liquid chamber 16*a* in order to eject liquid from the nozzle 16, a gas which is dissolved in liquid appears as air bubbles, and a change in pressure which occurs along with driving of the piezoelectric element is not sufficiently transmitted to the nozzle 16, and this causes an ejection failure of liquid droplets. In addition, since liquid does not flow in the liquid ejecting apparatus 11 at a time of not performing ejection of liquid, when liquid is a solution including an ingredient with a sedimentation property such as a pigment, there is a case in which the pigment, or the like, sediments, and causes a difference in concentration of liquid.

Therefore, when the liquid ejecting unit 13 does not eject liquid, a circulation process in which liquid is circulated between the common liquid chamber 17 and the liquid accommodation unit 12 is performed by returning the liquid in the common liquid chamber 17 to the liquid accommodation unit 12 through the return flow path 18.

Similarly to the first pouring process, the circulation process is performed by driving the circulation pump 20 after the control unit 100 sets the on-off valve 19 to an open state. That is, when the circulation pump 20 is driven, as denoted by the dotted arrow in FIG. 1, liquid in the common liquid chamber 17 flows to the liquid accommodation unit 12 through the return flow path 18, and the valve 37 causes the supply chamber 35 and the pressure chamber 33 to communicate with each other due to depressurizing in the common liquid chamber 17 and the pressure chamber 33.

Then, liquid is supplied to the supply chamber 35 through the liquid flow path 14 from the storage unit 43, and liquid in the liquid accommodation unit 12 is supplied to the storage unit 43 using the discharging pump 50 and the pressurizing pump 45. In this manner, liquid circulates between the liquid accommodation unit 12 and the common liquid chamber 17. Then, agitating of a pigment, or the like, is performed due to a flow of liquid, and foreign substances such as air bubbles which are present in the common liquid chamber 17, or the like, are collected in the liquid accommodation unit 12. In this manner, when air bubbles are collected in the liquid accommodation unit 12 by circulating liquid, the collected air bubbles may be stimulated so as to be defoamed when floating on the liquid surface by opening the liquid accommodation unit 12 to atmosphere.

In addition, when the circulation process is performed in the liquid ejecting apparatus 11, there is a case in which a pressure in the common liquid chamber 17 fluctuates along with flowing of liquid. When such a pressure fluctuation influences the nozzle 16, there is a case in which a meniscus of liquid which is formed in the nozzle 16 is destroyed, and liquid leaks from the nozzle 16. For this reason, it is preferable to perform capping of the liquid ejecting unit 13 using the cap 51 when performing the circulation process. In this case, it is preferable to open the atmosphere opening valve 57 of the cap 51.

In addition, when liquid is caused to flow by driving the circulation pump 20 in the circulation process, there is a case in which a pressure in the common liquid chamber 17 is a negative pressure which is lower than an atmospheric pressure. When such a negative pressure influences the nozzle 16, there is a case in which a meniscus of liquid which is formed in the nozzle 16 is destroyed, and air is drawn from the nozzle 16. For this reason, it is preferable to drive the circulation pump 20 to an extent of not drawing air from the nozzle 16 when performing the circulation process. For example, it is preferable to drive the circulation pump 20 so that a pressure which acts on the meniscus which is formed in the nozzle 16 due to flowing of liquid becomes lower than a withstand pressure of the meniscus.

Subsequently, a pressurizing cleaning process which is one of maintenance operations in which liquid is discharged from the liquid ejecting unit 13 will be described with reference to FIG. 5.

Figure 5:
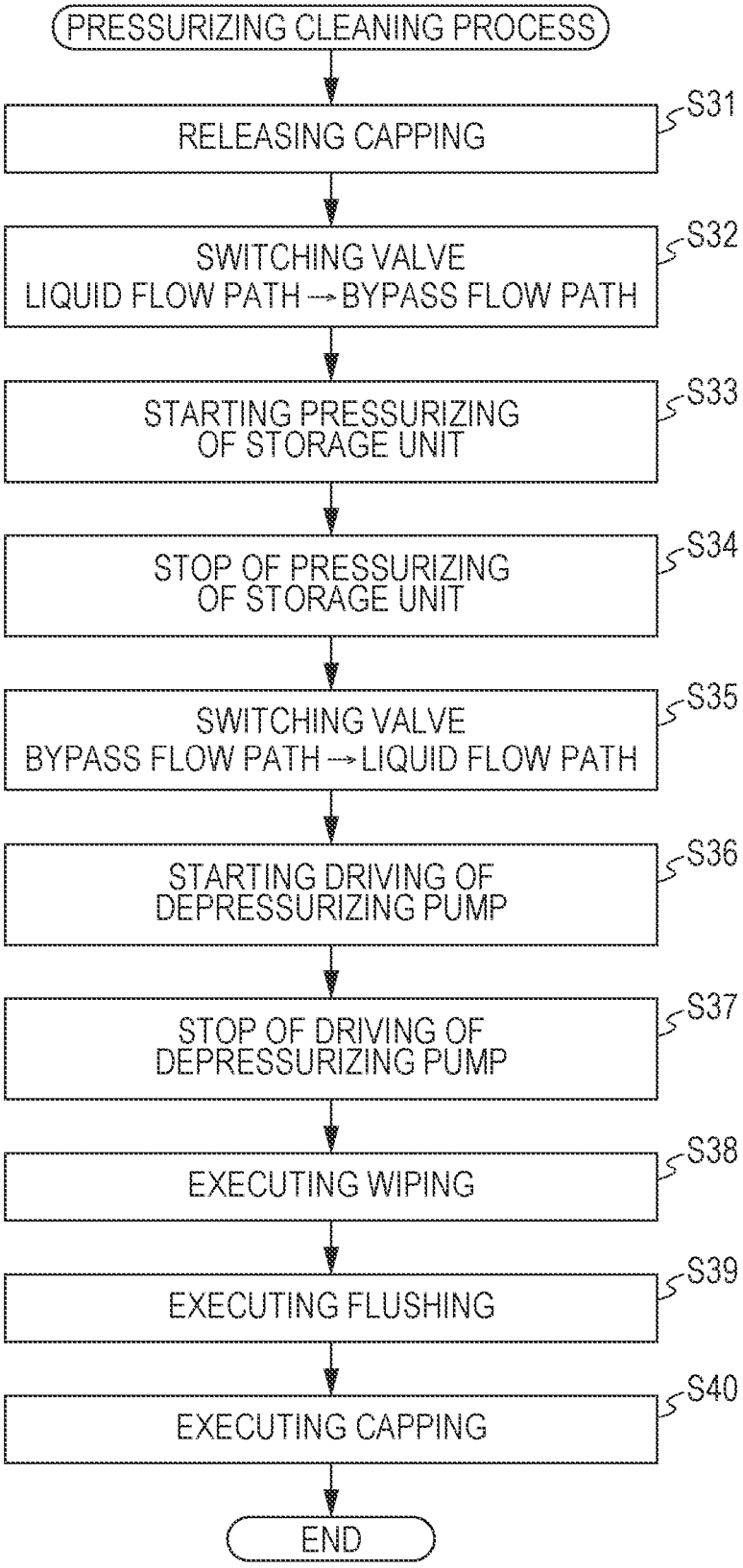
FIG. 5 is a flowchart which illustrates execution order of a pressurizing cleaning process.

As illustrated in FIG. 5, as step S31, the control unit 100 releases capping of the liquid ejecting unit 13. In addition, when releasing the capping, as illustrated in FIG. 1, the cap 51 is arranged at a position which faces an opening of the nozzle 16 (for example, position which becomes lower part of opening face 13*a* in vertical direction).

Subsequently, as step S32, the control unit 100 closes the valve 42*a* of the switching valve 42 and opens the valve 42*b*, and switches a flow path with which the storage unit 43 communicates from the liquid flow path 14 which is connected to the pressure adjusting unit 31 to the bypass flow path 41.

Subsequently, as step S33, the control unit 100 starts additional pressurizing of the storage unit 43 by driving the vacuum pump 24, or the like. In addition, it is also possible to perform pressurizing of the storage unit 43 by driving the pressurizing pump 45 instead of driving the vacuum pump 24, or by driving the pressurizing pump 45, in addition to driving of the vacuum pump 24.

In this manner, liquid which is stored in the storage unit 43 is supplied to the common liquid chamber 17 by being pressurized through the bypass flow path 41 as denoted by the two dot chain line in FIG. 1. Then, the liquid in the common liquid chamber 17 flows out from the nozzle 16, and is accommodated using the cap 51. In this manner, foreign substances such as air bubbles which are present in the common liquid chamber 17 or the liquid chamber 16*a*, liquid which is thickened due to evaporation of a solvent ingredient, or the like, which causes an ejection failure is discharged through the nozzle 16 along with liquid.

When an amount of liquid which is sufficient for discharging foreign substances is discharged from the nozzle 16, as step S34, the control unit 100 stops additional pressurizing of the storage unit 43 by stopping driving of the vacuum pump 24, or the like.

In addition, as step S35, the control unit 100 switches the flow path with which the storage unit 43 communicates from the bypass flow path 41 to the liquid flow path 14 to which the pressure adjusting unit 31 is connected by opening the valve 42*a* of the switching valve 42, and closing the valve 42*b*, and returns the switching valve to the normal state.

Subsequently, as step S36, the control unit 100 starts driving of the depressurizing pump 56. In this manner, the liquid accumulated in the cap 51 is discharged to the waste liquid tank 54 through the discharge flow path 55. When discharging of liquid in the cap 51 is finished, as step S37, the control unit 100 stops driving of the depressurizing pump 56.

Thereafter, as step S38, the control unit 100 moves the moving body 59, and executes wiping. In this manner, liquid droplets, and the like, which are attached to the opening face 13*a* are eliminated along with discharging of liquid from the nozzle 16.

In addition, the pressurizing cleaning process is finished when the control unit 100 fixes a meniscus of the nozzle 16 by executing flushing as step S39, and executes capping as step S40. In addition, when printing is performed immediately after executing the pressurizing cleaning, or the like, capping in step S40 may not be performed.

Subsequently, operations of the liquid ejecting apparatus 11 will be described.

When liquid is ejected from the nozzle 16 in the liquid ejecting apparatus 11, flowing of liquid from the common liquid chamber 17 to the return flow path 18 is suppressed by opening the on-off valve 19, and liquid is supplied to the pressure adjusting unit 31 through the liquid flow path 14 in a state in which the switching valve 42 switches the flow path of the liquid to the liquid flow path 14. For this reason, it is possible to rapidly supply liquid from the pressure adjusting unit 31 to the common liquid chamber 17 along with a consumption of liquid while maintaining a back pressure of the nozzle 16 at a pressure which is appropriate for ejection of liquid using the pressure adjusting unit 31.

In contrast to this, when performing pressurizing cleaning which is maintenance in which liquid is caused to flow out from the nozzle 16, liquid is supplied to the common liquid chamber 17 through the bypass flow path 41 in a state in which the on-off valve 19 is closed, and the switching valve 42 switches a flow path of the liquid to the bypass flow path 41. That is, it is possible to discharge foreign substances from the liquid ejecting unit 13 by causing pressurized liquid to flow out from the nozzle 16 powerfully by sending the liquid from the storage unit 43 to the common liquid chamber 17 without passing through the pressure adjusting unit 31.

In addition, when performing pressurizing cleaning, liquid flows into the common liquid chamber 17 through a part of the return flow path 18 which is located between the bypass flow path 41 and the common liquid chamber 17. For this reason, it is preferable to suppress flowing of foreign substances into the common liquid chamber 17 along with the pressurizing cleaning operation by providing a foreign substance capturing unit such as a filter 60, or the like, in the return flow path 18 which is located between the bypass flow path 41 and the common liquid chamber 17.

In addition, since the liquid ejecting apparatus 11 includes the return flow path 18, liquid in the common liquid chamber 17 is collected in the liquid accommodation unit 12 by causing liquid on the return flow path 18 to flow toward the liquid accommodation unit 12 by opening the on-off valve 19. In this manner, it is possible to suppress mixing in of air bubbles in the liquid chamber 16*a* or the nozzle 16 by collecting foreign substances such as air bubbles which are accumulated in the common liquid chamber 17, or the like, in the liquid accommodation unit 12.

In addition, when circulating liquid in order of the common liquid chamber 17, the return flow path 18, the liquid accommodation unit 12, and the liquid flow path 14 by driving the circulation pump 20, the discharging pump 50 and the pressurizing pump 45 by opening the on-off valve 19, the liquid on the flow path is agitated. In this manner, it is possible to suppress a change in concentration of liquid even when the liquid includes an ingredient with a sedimentation property such as a pigment. That is, since it is possible to suppress an occurrence of ejection failure of the nozzle 16 or deterioration in printing quality without discarding liquid including foreign substances or liquid of which concentration is changed, by causing the liquid to flow out from the nozzle 16, it is possible to reduce an amount of liquid which is consumed for maintenance.

In addition, even when liquid including air bubbles is collected in the liquid accommodation unit 12, liquid which is supplied to the common liquid chamber 17 from the liquid accommodation unit 12 is deaerated in the deaeration unit 21 whether the flow path is the liquid flow path 14 or the bypass flow path 41. In this manner, occurrence of air bubbles in the flow path from the deaeration unit 21 to the nozzle 16, or in the pressure adjusting unit 31 is suppressed.

According to the embodiment, it is possible to obtain the following effects.

(1) It is possible to collect air bubbles which are mixed in the common liquid chamber 17 or the liquid flow path 14 in the liquid accommodation unit 12 by causing liquid in the common liquid chamber 17 to flow in the liquid accommodation unit 12 through the return flow path 18. In addition, it is possible to eject deaerated liquid from the nozzle 16 since deaeration of liquid is performed using the deaeration unit 21 in the liquid flow path 14 through which liquid is supplied to the common liquid chamber 17. That is, by performing deaeration in the liquid flow path 14, it is possible to reduce mixing of air bubbles into liquid which is accompanied with ejection, or a growth of air bubbles in liquid compared to a case in which deaeration of liquid is performed in the liquid accommodation unit 12.

(2) It is possible to collect liquid in the common liquid chamber 17 into the liquid accommodation unit 12 without passing through the deaeration unit 21, by causing liquid on the return flow path 18 to flow toward the liquid accommodation unit 12 by opening the on-off valve 19. In this manner, it is possible to efficiently perform deaeration of liquid which is accompanied with ejection by suppressing intermixing of liquid which is subjected to deaeration and liquid including air bubbles.

(3) It is possible to supply liquid of which a pressure is appropriately adjusted in the pressure adjusting unit 31 to the nozzle 16 by supplying liquid to the pressure adjusting unit 31 through the liquid flow path 14, when the liquid is ejected from the nozzle 16. Meanwhile, when maintenance is performed, it is possible to cause liquid of which the pressure is not adjusted to flow out from the nozzle 16 powerfully, by supplying the liquid to the common liquid chamber 17 through the bypass flow path 41 without passing through the pressure adjusting unit.

(4) When liquid is flown out from the nozzle 16, the flexible unit 32 performs deflection displacement in a direction in which a volume of the pressure chamber 33 decreases due to a decrease in pressure of the pressure chamber 33 when liquid in the pressure chamber 33 is supplied to the common liquid chamber 17. In addition, the valve 37 causes the pressure chamber 33 and the supply chamber 35 to communicate with each other according to the displacement of the flexible unit 32. In addition, since deaerated liquid is supplied to the supply chamber 35 in a state of being pressurized using the liquid flow unit, when the pressure chamber 33 and the supply chamber 35 communicate with each other, liquid rapidly flows into the pressure chamber 33 from the supply chamber 35. In addition, when a pressure of the pressure chamber 33 returns to the original state due to flowing in of liquid, flowing in of liquid to the pressure chamber 33 from the supply chamber 35 is stopped due to an urging force of the urging member 36. On the other hand, when liquid is not flown out from the nozzle 16, since the pressure in the pressure chamber 33 does not decrease, and pressurized liquid does not flow into the common liquid chamber 17 through the pressure chamber 33, a meniscus in liquid which is formed in the nozzle 16 is not destroyed due to the pressure. That is, it is possible to appropriately adjust a pressure in the common liquid chamber 17 according to flowing out of liquid from the nozzle 16 using the pressure adjusting unit 31.

(5) It is possible to suppress mixing in of foreign substances in the deaeration unit 21 by capturing foreign substances which are mixed into liquid using the filter 48 which is the foreign substance capturing unit or the air trap 49 in the middle of the liquid flow path 14 which goes toward the deaeration unit 21 from the liquid accommodation unit 12. It is possible to suppress deterioration in a deaeration property in the deaeration unit 21, since clogging of the hollow fiber membrane 22 is suppressed in this manner.

(6) It is possible to perform deaeration by eliminating a gas in liquid when the depressurizing mechanism 25 performs depressurizing of liquid. In addition, it is possible to cause liquid to flow from the deaeration unit 21 to the common liquid chamber 17 by pressurizing liquid which is depressurized using the pressurizing pump 45 which functions as the liquid flow unit.

In addition, the embodiment may be modified as the following modification examples.

Deaeration of liquid is not limited to depressurizing using the hollow fiber membrane 22, and it is possible to adopt an arbitrary method such as ultrasonic deaeration or centrifugal deaeration.

In the pressurizing cleaning process, the atmosphere opening valve 57 may be opened instead of releasing capping in step S31. According to the configuration, it is possible to suppress disperal of liquid which flows out from the nozzle 16, since it is possible to execute pressurizing cleaning while performing capping.

At least one of pouring of liquid into the common liquid chamber 17 and pouring of liquid into the nozzle 16 may be performed by executing steps S31 to S34 of the above described pressurizing cleaning process.

In the liquid flow path 14, a cross-sectional area of a flow path of a common liquid flow path which is on the upstream side of branching liquid flow paths which branch off according to the number of common liquid chambers 17, and is on the downstream side of the switching valve 42 may be set to be larger than cross-sectional areas of flow paths on the front and rear sides thereof as illustrated in FIG. 1.

In the return flow path 18, a cross-sectional area of a common return flow path which is on the downstream side of branching return flow paths which branch off according to the number of common liquid chambers 17, and is on the upstream side of the on-off valve 19 may be set to be larger than cross-sectional areas of flow paths on the front and rear sides thereof as illustrated in FIG. 1.

Liquid which is ejected from the liquid ejecting unit may be liquid or a substance in a liquid-like state other than ink. For example, a configuration may be adopted in which recording is performed by ejecting a liquid body including a material such as an electrode material, or a coloring material (material of pixel) which is used when manufacturing, for example, a liquid crystal display, an electroluminescence (EL) display, a surface emission display, or the like, in a form of dispersion, mixing, or dissolution.

A medium is not limited to a sheet, and may be a plastic film, a panel, or the like, or, may be cloth which is used in a fabric printing apparatus, or the like.

What is claimed is:

1. A liquid ejecting apparatus comprising:

a plurality of nozzles which eject liquid;

a common liquid chamber which supplies liquid to the plurality of nozzles;

a liquid flow path for supplying liquid which is accommodated in a liquid accommodation unit to the common liquid chamber;

a deaeration unit which deaerates liquid in the liquid flow path;

a liquid flow unit which causes liquid in the liquid flow path to flow;

a pressure adjusting unit which is provided between the deaeration unit and the common liquid chamber in the liquid flow path, and adjusts a pressure of liquid which is supplied to the common liquid chamber;

a return flow path which connects the common liquid chamber and the liquid accommodation unit;

an on-off valve which closes the return flow path by being in a closed state; and a bypass flow path of which an upstream end is connected between the deaeration unit and the pressure adjusting unit in the liquid flow path, and of which a downstream end is connected between the on-off valve and the common liquid chamber in the return flow path.

2. The liquid ejecting apparatus according to claim 1, wherein liquid in the common liquid chamber is collected in the liquid accommodation unit when liquid on the return flow path is caused to flow toward the liquid accommodation unit by opening the on-off valve.

3. The liquid ejecting apparatus according to claim 1, further comprising:

a switching valve which switches a flow path of liquid which flows toward the common liquid chamber from the deaeration unit between the liquid flow path and the bypass flow path, wherein liquid is supplied to the pressure adjusting unit through the liquid flow path in a state in which the on-off valve is closed, and the switching valve switches the flow path of liquid to the liquid flow path, when liquid is ejected from the nozzle, and wherein liquid is supplied to the common liquid chamber through the bypass flow path in a state in which the on-off valve is closed, and the switching valve switches the flow path of the liquid to the bypass flow path, when maintenance of causing liquid to flow out from the nozzle is performed.

4. The liquid ejecting apparatus according to claim 1, wherein the pressure adjusting unit includes a pressure chamber of which a volume is changed when a flexible unit which configures a wall portion performs deflection displacement;

a supply chamber which communicates with the pressure chamber through a communication flow path;

an urging member which urges the flexible unit in a direction in which the volume of the pressure chamber increases; and a valve which displaces in a direction in which the pressure chamber and the supply chamber communicate with each other according to a displacement of the flexible unit, when a pressure in the pressure chamber is lower than a pressure on an outer side of the flexible unit, wherein the supply chamber communicates with the deaeration unit through the liquid flow path, and the pressure chamber communicates with the common liquid chamber through the liquid flow path, and wherein a pressure in the pressure chamber decreases due to supplying of liquid in the pressurizing chamber to the common liquid chamber when the liquid flow unit supplies liquid which is in a pressurized state from the deaeration unit to the supply chamber, and liquid flows out from the nozzle.

5. The liquid ejecting apparatus according to claim 1, further comprising:

a foreign substance capturing unit which captures foreign substances which are mixed into the liquid between the liquid accommodation unit and the deaeration unit in the liquid flow path.

6. The liquid ejecting apparatus according to claim 1, wherein the deaeration unit includes a depressurizing mechanism which depressurizes liquid in the liquid flow path in order to perform deaeration, and wherein the liquid flow unit supplies liquid which is in a pressurized state from the deaeration unit to the common liquid chamber.

7. The liquid ejecting apparatus according to claim 1, further comprising:

a cap which performs capping with respect to a region to which the plurality of nozzles are open, wherein the liquid on the return flow path is caused to flow toward the liquid accommodation unit by opening the on-off valve in a state in which the region is capped using the cap.

8. The liquid ejecting apparatus according to claim 1, further comprising:

a cap which performs capping with respect to the region to which the plurality of nozzles are open, wherein, when performing maintenance in which liquid is caused to flow out from the nozzle, the cap faces the plurality of nozzles, and liquid is supplied to the common liquid chamber through the bypass flow path in a state in which the on-off valve is closed.

* * * * *